United States Patent [19]

Rudick

[11] Patent Number: 4,892,229

[45] Date of Patent: Jan. 9, 1990

[54] SYSTEM FOR DISPENSING LIQUID FROM A PAPERBOARD CARTON

[75] Inventor: Arthur G. Rudick, Marietta, Ga.

[73] Assignee: The Coca-Cola Company, Atlanta, Ga.

[21] Appl. No.: 236,183

[22] Filed: Aug. 24, 1988

[51] Int. Cl.[4] ..... B65D 35/56

[52] U.S. Cl. ..... 222/105; 222/160; 222/505; 222/511; 222/559; 251/7

[58] Field of Search ..... 222/105, 160, 164–167, 222/505, 506, 511, 512, 515, 544, 545, 559; 251/7, 8

[56] References Cited

U.S. PATENT DOCUMENTS

| | | | |
|---|---|---|---|
| 2,523,066 | 9/1950 | Seifert | 222/103 |
| 2,958,502 | 11/1960 | Grigsby | 251/8 |
| 3,116,854 | 1/1964 | Rabb et al. | 222/506 X |
| 3,568,496 | 3/1971 | Burke et al. | 251/7 X |
| 3,733,046 | 5/1973 | Press | 251/8 |
| 4,286,733 | 9/1981 | Weikert | 222/105 |

FOREIGN PATENT DOCUMENTS

| | | | |
|---|---|---|---|
| 498439 | 5/1976 | U.S.S.R. | 251/7 |

*Primary Examiner*—Kevin P. Shaver

*Attorney, Agent, or Firm*—Birch, Stewart, Kolasch & Birch

[57] ABSTRACT

A system for dispensing liquid from a relatively large laminated paperboard container or carton from an outward facing compartment in a housing. The carton, opened by cutting off one of the corners, is inserted in an upright position in a frame so that the open corner is located within a pinch mechanism including mutually perpendicular pairs of plates having opposing edges adapted to contact opposite walls of the open corner of the carton, with the pairs of plates being interconnected so that as one pair of edges move toward one another, the other pair of edges move away from each other, and vice versa, and accordingly operate to open and close the carton during a dispensing operation.

15 Claims, 4 Drawing Sheets

SYSTEM FOR DISPENSING LIQUID FROM A PAPERBOARD CARTON

BACKGROUND OF THE INVENTION

This invention relates generally to apparatus for dispensing a liquid from a box type container and more particularly to an apparatus for gravity dispensing a liquid from a laminated paperboard carton or the like through a reclosable corner opening.

Liquid containers and the means for controlling the delivery of a liquid from the container take many forms and ultimately depends upon the environment within which they are used and the particular type of material being dispensed. Where gravity flow devices are employed, there is usually included some type of controlled delivery port located at the bottom of the container which is either manually or mechanically operated. In some configurations, controlled delivery is accomplished by constricter means positioned around a flexible tube or the like.

More recently, apparatus for controlling the flow of a liquid from a flexible bag has become known.Such apparatus utilizes opposed pairs of jaws which grip a portion of the bag material adjacent a lowermost corner of the bag on opposite sides thereof. A camming system causes the jaws to move towards and away from each other to alternately relax and render taut the material adjacent an opening formed by cutting off the lowermost corner of the bag to permit and restrict the flow of liquid through the opening. Cooperating with the gripping jaws are a pair of resilient sealing bars which move together just above the opening and seal the opening against flow when the jaws move apart from each other. While this apparatus presumably operates as intended, its construction is relatively complicated and unworkable for a generally rectangularly shaped carton constructed of laminated paperboard.

SUMMARY OF THE INVENTION

Accordingly, it is an object of the present invention to provide a system for dispensing liquids from a container.

It is a further object of the invention to provide apparatus for dispensing liquids from a generally rectangularly shaped package.

It is another object of the invention to provide a relatively simple yet effective means for dispensing liquid from a laminated paperboard carton.

It is yet another object of the invention to provide a pinch mechanism for dispensing liquid from a generally flexible box shaped carton.

Briefly, the present invention is directed to a system for dispensing liquid from a relatively large laminated paperboard container or carton which can be used to dispense juice, for example, from an outward facing compartment within a refrigerator door. The carton is first opened by cutting off one of the corners,installing the carton in an upright position in a frame so that the open corner is located within a pinch mechanism including mutually perpendicular pairs of plates having opposing edges adapted to contact opposite walls of the open corner of the carton with the pairs of plates being interconnected so as one pair of edges move toward one another, the other pair of edges move away from each other and vice versa and accordingly operate to open and close the carton during a dispensing operation.

DESCRIPTION OF THE PREFERRED EMBODIMENT

This invention is directed to apparatus for dispensing a liquid directly from a relatively large laminated paperboard carton such as a large version of a "TETRA BRIK"-package. "TETRA BRIK" is a registered trademark for a known carton type of container. The intended use of this invention is to dispense pre-packaged fruit juice, for example, from an outward facing compartment of a refrigerator door, thus permitting a consumer to dispense cold juice without opening the refrigerator door. In order to utilize the invention, the consumer would open one corner of a "TETRA BRIK" package by cutting along a prescribed dotted line, for example, with a pair of scissors. No additional closures are necessary. The open package is loaded in an upright position into a boxholder and having an adjoining pinch mechanism, to be hereinafter explained, and then inverted, typically by rotating the assembly on a hinge whereupon the dispenser is ready for use.

Figure 1:
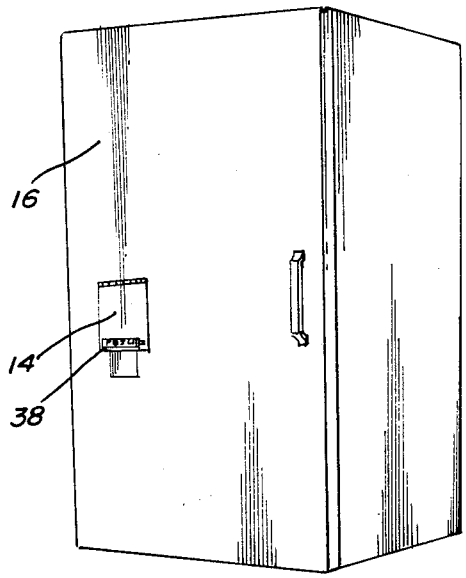
FIG. 1 is a perspective view of the invention installed in a standard refrigerator door.
Figure 2:
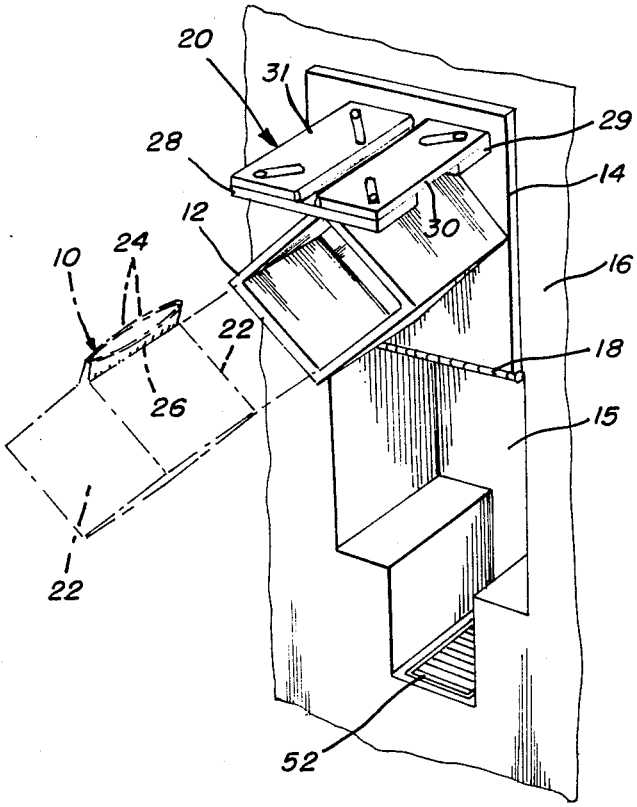
FIG. 2 is a perspective view of a pinch mechanism in accordance with the invention mounted on a juice box door swung upwardly and a juice box carton shown in phantom line ready for installation therein.

Referring now to the drawings wherein like reference numerals refer to like parts throughout, reference numeral 10 in FIG. 2 denotes a generally rectangularly shaped laminated paperboard package or carton of the "TETRA BRIK" type. The container 10 is mounted in a boxholder element 12 which comprises an open rectangular frame which is secured to the rear side of a hinged door member 14 which is attached to a refrigerator door 16 (FIG. 1), adjacent an opening 15 therein by means of a hinge device 18, for example, located along the upper edge of the door member 14. The open boxholder frame 12 is tilted at a generally 45 angle relative to the edges of the hinged door 14 so that the corners of a "TETRA BRIK" package inserted therein are coincident with a horizontal and vertical axis and thus one edge of the package 10 is pointed downwardly when in use.

Figure 3:
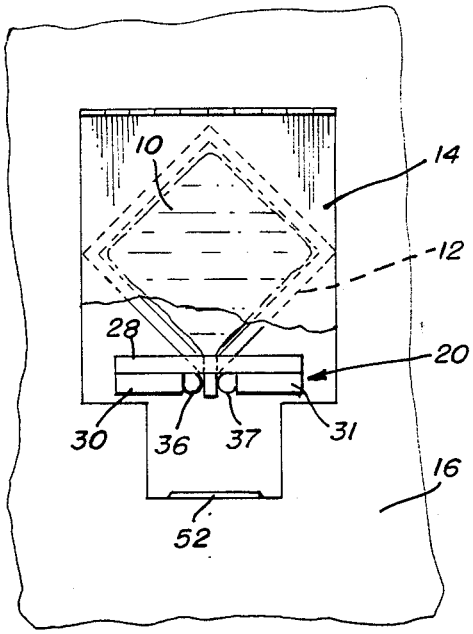
FIG. 3 is a front elevation of the device with the juice box door in position and partially broken away and illustrating the pinch mechanism of FIG. 2 in the closed position.
Figure 4:
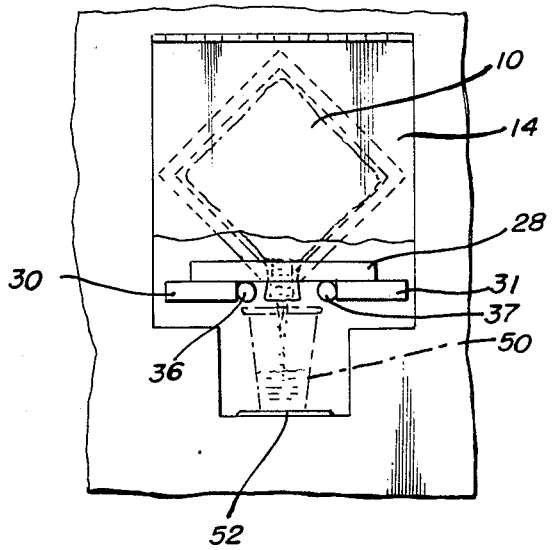
FIG. 4 is a view similar to FIG. 3 with the pinch mechanism shown in the open position.

At one corner which corresponds to the lower corner of the boxholder 12 when the door 14 is lowered into a use position as shown in FIG. 3, there is located a pinch mechanism which is generally shown by reference numeral 20 and which operates to control flow of the liquid from the package 10 when one corner thereof is opened and inserted into the pinch mechanism 20 as shown in FIGS. 3 and 4. The construction of the "TETRA BRIK" package 10 is such that it is comprised of flat front and rear walls 22 and intermediate relatively narrow side walls 24 which are adapted to fold inwardly and outwardly along a crease 26.

Figure 5:
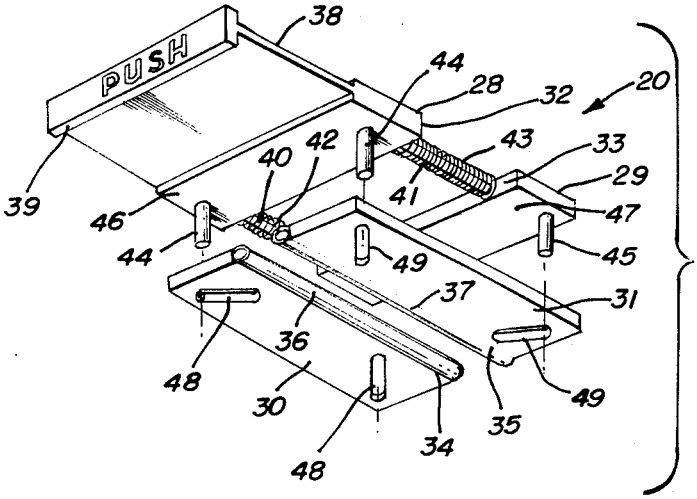
FIG. 5 is an exploded perspective view of the pinch mechanism shown in FIGS. 3 and 4.
Figure 6A:
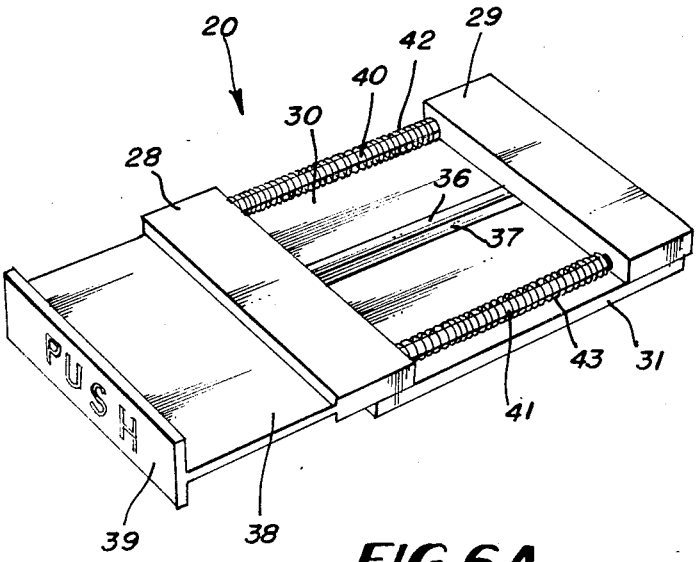
FIGS. 6A and 6B are perspective views of the pinch mechanism shown in FIG. 5 and being illustrative of its operation.
Figure 6B:
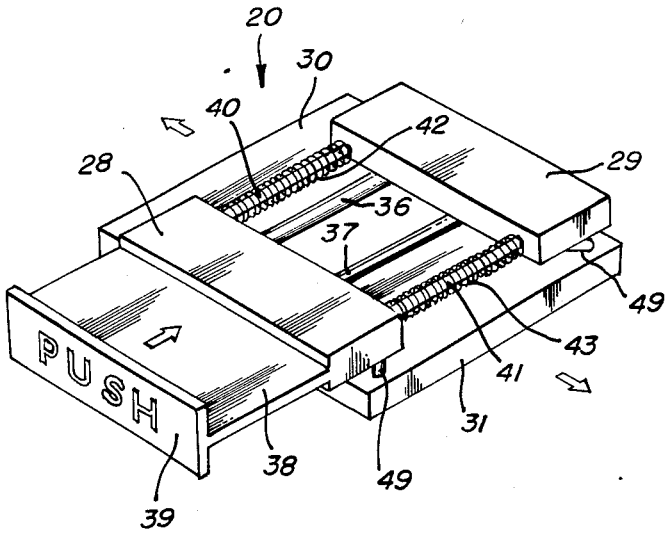

The details of the pinch mechanism 20 are shown in FIG. 5 while its operation is illustrated in FIGS. 6A and 6B. The mechanism is comprised of an upper pair of side plates 28 and 29 and a lower pair of adjacent sealing plates 30 and 31. The pairs of plates 28, 29 and 30, 31 are oriented so that they are mutually perpendicular to one another. The plate 29 remains in a fixed position by being attached, for example, to the hinged door member 14 while the plate 28 is adapted to move toward and away from the plate 29. Both of the lower sealing plates 30 and 31, however, are movable in mutually opposite directions sideways relative to the upper side plates 28 and 29 along a linear axis perpendicular to the lengthwise dimension of the upper side plates. Both sets of plates are comprised of generally rectangular blocks having respective relatively narrow elongated flat opposing inside edge surfaces 32, 33 and 34, 35. The inside edge surfaces 34 and 35 of the lower sealing plates 30 and 31 also have elongated compression members 36 and 37 in the form of tubular elements affixed thereto. The outer side plate 28 further includes an outer extension member 38 which terminates in a flat bar type element 39 for acting as a push-type actuator.

Further as shown, a pair of guide bars 40 and 41 extend between the outer ends of side plates 28 and 29 where they enter the opposing inner edge surfaces 32 and 33 thereof. The side plates, moreover, include elongated bores therein so that they can be pushed together when pressure is exerted on the actuator bar 39. A pair of compression springs 42 and 43 are located on the guide bars 40 and 41 to normally bias the side plates 28 and 29 apart in absence of any pressure being applied to the bar 39.

Each side plate 28 and 29 respectively includes a pair of vertically depending generally cylindrical pin type elements 44 and 45 which project from the under surfaces 46 and 47 thereof. The purpose of the pins 44 and 45 is to engage respective slots 48 and 49 formed in the underlying body portions of the sealing plates 30 and 31. The slots 48 and 49 are slanted inwardly relative to the elongated side edges of the plates 30 and 31, with each pair of slots 48 and 49 being located in each plate at opposite ends thereof as shown in FIG. 5. The side plates 28, 29 and the sealing plates 30, 31 are thus interconnected and cooperate so that as the side plates 28 move toward one another, the sealing plates 30 move away from one another, and vice versa.

Since the top side plates are normally biased apart by virtue of the compression springs 42 and 43, the sealing plates 30 and 31 are accordingly forced together thereby keeping the corner opening of the package 10 closed. The pressure exerted by the elongated compression members 36 and 37 located on the inside edges 34 and 35 of the sealing plates 30 and 31 further act to seal the corner opening of the carton 10 by pressing against the surfaces of the side walls 24. When liquid is desired to be dispensed, an inward pressure is exerted on the push bar 39, causing the side plate 28 to move toward the fixed rear plate 29. This in turn causes the sealing plates 30 and 31 to move apart. The inner surfaces 32 and 33 of the side plates 28 and 29 engage the adjacent portion of the front and rear walls of the package 10, causing the side walls of the package 24 to fold open, whereupon the liquid will flow through the opening thereat by gravity and into a receptacle such as the cup 50 placed thereunder on the drip tray 52 incorporated in the refrigerator door opening 15 beneath the hinged door 14 containing the package holder frame 12. In closing, a reverse operation is caused whereby the side plates 28 and 29 retract and the sealing plates 30 and 31 again move together.

Figure 7:
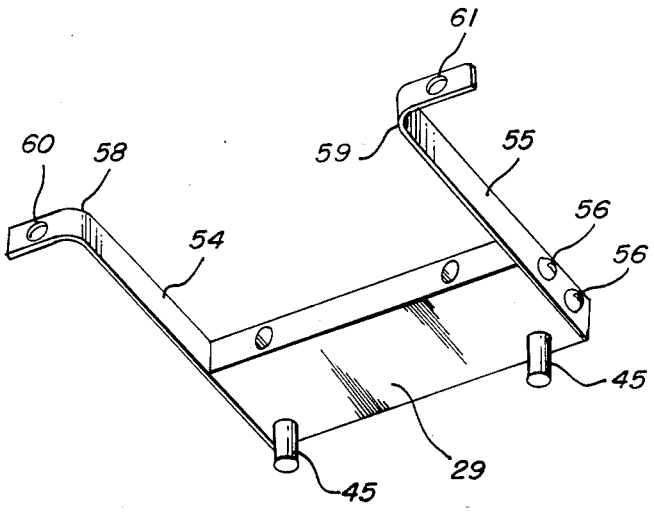
FIG. 7 is a perspective view of an alternate mounting arrangement for the pinch mechanism shown in FIG. 5.
Figure 8A:
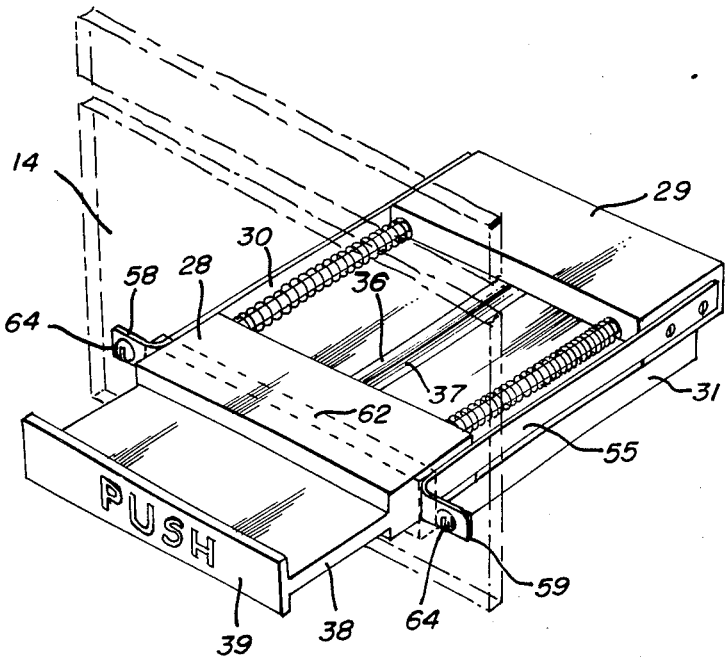
FIGS. 8A and 8B are perspective views of the pinch mechanism mounted in the bracket shown in FIG. 7 and being illustrative of its operation.
Figure 8B:
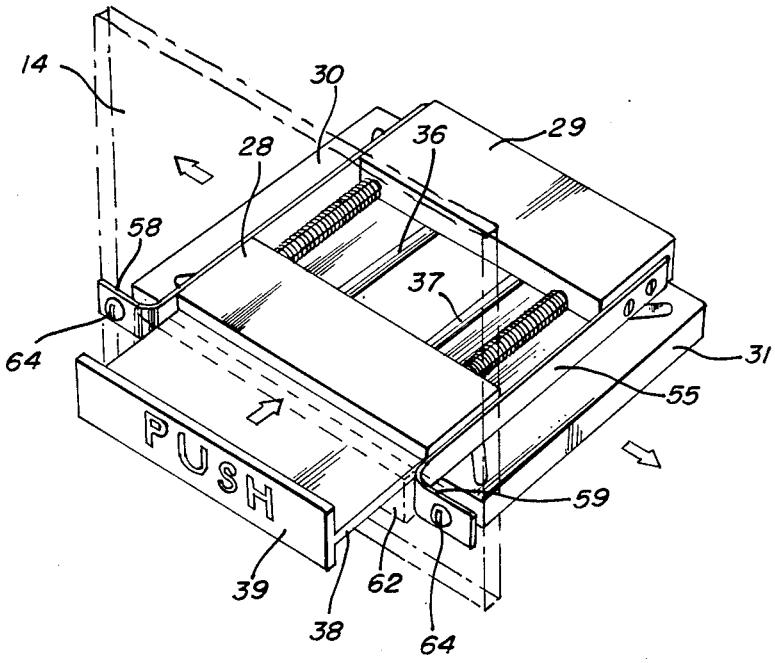

An alternate arrangement for mounting the pinch mechanism 20 on the door 14 is shown in FIGS. 7, 8A and 8B. Referring now to FIG. 7, shown thereat is a pair of elongated angle brackets 54 and 55 which are secured at one end by hardware elements 56 to the rear upper side plate 29. The other or forward end of the brackets 54 and 55 terminate in right-angled portions 58 and 59 including mounting holes 60 and 61 for attachment to the inside surface of the hinged door 14 as shown in FIGS. 8A and 8B. Further as shown in FIGS. 8A and 8B, the door 14 now includes an elongated transverse rectangular slot 62 through which the forward portion of upper side plate 28 as well as the extension member 38 therefor and its adjoining puch bar 39 can pass. Hardware elements 64 are shown securing the brackets 54 and 55 to the door 14. With the rear side plate 29 thus being held stationary, the operation of the pinch mechanism is the same as previously described as illustrated in FIGS. 6A and 6B.

Thus what has been shown and described is a relatively simple yet effective means of controlling the dispensing of a liquid from "TETRA BRIK" type of liquid package located in a relatively large housing such as a refrigerator.

Having thus shown and described what is at present considered to be the preferred embodiment of the invention, it should be noted that the same has been made by way of illustration and not limitation. Accordingly, all alterations, modifications and changes coming within the spirit and scope of the invention are herein meant to be included.

I claim:

1. Apparatus for dispensing a liquid from a carton-type liquid container having a flexible reclosable opening located at one corner thereof, comprising:

means for holding the container so that the opening at the corner is located at the bottom during normal use whereby liquid can be dispensed by gravity downwardly through the opening; and means located on said holding means for controlling the opening and closing of the opening and thus the dispensing of liquid from the container, said controlling means comprising a pinch mechanism including mutually perpendicular adjacent pairs of pressure plates having mutually opposing parallel side wall surfaces for engaging and compressing respective pairs of opposite walls of the container at the opening, and means for interconnecting said pairs of plates to move in unison and mutual opposition and thereby alternately open and close the opening at the corner during a dispensing operation.

2. The apparatus as defined by claim 1 wherein said container comprises a generally rectangular package and wherein said means for holding the container comprises a generally rectangular open frame having corners oriented along a horizontal and vertical axis.

3. The apparatus as defined by claim 2 and additionally including a support member having a front and back side and wherein said frame is mounted on the back side of said support member, said package being placed in the frame with said opening being pointed up during a loading operation to prevent spilling of the liquid and thereafter turned over to enable a dispensing operation by said pinch mechanism during normal use.

4. The apparatus as defined by claim 1 wherein said pairs of plates comprise an upper plate pair and a lower plate pair, said upper plate pair being operable to open said container and the lower plate pair being operable to close said container.

5. The apparatus as defined by claim 1 and additionally including means on one of said pairs of plates for holding one plate of said one pair of plates stationary, means for moving the other plate alternately toward and away from the stationary plate along a first linear axis, and wherein said interconnecting means moves said other pair of plates in mutually opposite directions along a second linear axis perpendicular to the first axis.

6. The apparatus as defined by claim 5 wherein said means for moving said other plate of said one pair of plates includes means for manually actuating said other plate of said one pair of plates.

7. The apparatus as defined by claim 6 wherein said means for manually actuating said other plate includes means for pushing said other plate of said one pair of plates toward said one stationary plate.

8. The apparatus as defined by claim 7 wherein said one pair of plates are slidably coupled by a pair of guide bars extending therebetween.

9. The apparatus as defined by claim 8 and additionally including a pair of compression springs respectively mounted on said pair of guide bars for biasing said other plate away from the stationary plate.

10. The apparatus as defined by claim 5 and additionally including compression spring means contacting the mutually opposed parallel side wall surfaces of said one pair of plates for urging said other plate away from said one stationary plate.

11. The apparatus as defined by claim 10 wherein said one pair of plates are slidably coupled by at least one guide bar extending therebetween.

12. The apparatus as defined by claim 1 wherein said pairs of pressure plates comprise like shaped rectangular plates.

13. The apparatus as defined by claim 12, wherein said interconnecting means comprises a pair of spaced apart pin type elements projecting from a surface of each plate of one of said pair of plates facing a respective plate surface of said other pair of plates and wherein each plate of said other pair of plates includes a pair of mutually angulated slots in engagement with the pin type elements of said one pair of plates for being moved orthogonally to said one pair of plates.

14. The apparatus as defined by claim 12 wherein said pairs of plates surround the opening of said container and wherein said one pair of plates comprises a top pair of side plates which operate to open said opening at said one corner of the container and said other pair of plates comprises a lower pair of sealing plates which operate to close said opening.

15. Apparatus for dispensing a liquid from a laminated paperboard carton or the like through a reclosable opening in a corner of the carton, the apparatus comprising:

means for holding the carton in a fixed orientation such that the opening in said carton is at the bottom of the apparatus whereby the liquid can be caused to flow and be dispensed through the opening by gravity; and a pinch mechanism secured to said means for holding and positioned to surround and control the opening and closing of the opening in said carton to regulate the dispensing of liquid therethrough, the pinch mechanism further comprising, a first set of plates, each plate having means for contacting and moving a respective side portion of the carton adjacent said opening, one of said plates having means for moving relative to the other of said plates, the plates of said first set of plates normally being moved closely adjacent with each other by said means for moving for spreading first opposing portions of the carton surrounding the opening to enable the flow of liquid from said opening in a dispensing mode of operation;

a second set of plates movable in unison with the first set of plates, each plate of said second set of plates having means for moving second opposing portions of the carton adjacent said opening, the plates of said second set of plates having means interconnected with said first set of plates for movement in mutually opposite directions orthogonally relative to the first set of plates, such that the plates of said second set of plates are moved apart from each other and said second opposing portions of the carton in said dispensing mode enable the flow of liquid from said opening; and said first set of plates thereafter respectively pinching and spreading said first opposing portions of the carton in a dispensing mode to further enable the flow of liquid from said opening.

* * * * *